US005990398A

United States Patent [19]

Nonaka

[11] Patent Number: 5,990,398

[45] Date of Patent: Nov. 23, 1999

[54] KEY-PAD OPERATING MECHANISM OF SAXOPHONE

[75] Inventor: Hideki Nonaka, Kanagawa, Japan

[73] Assignee: Nonaka Boeki Co., Ltd., Kanagawawa-ken, Japan

[21] Appl. No.: 09/056,120

[22] Filed: Apr. 6, 1998

[30] Foreign Application Priority Data

Apr. 14, 1997 [JP] Japan ..... 9-095984

[51] Int. Cl.[6] ..... G10D 7/08; G10D 9/04

[52] U.S. Cl. ..... 84/385 R; 84/342; 84/380 R; 84/382; 84/384

[58] Field of Search ..... 84/342, 382, 384, 84/385 R, 385 A, 385 P, 380 R

[56] References Cited

U.S. PATENT DOCUMENTS 1,745,430 2/1930 MacDonald .

4,353,281 10/1982 DeFord ..... 84/384

FOREIGN PATENT DOCUMENTS 05276196 10/1993 Japan .

*Primary Examiner*—Paul Ip
*Assistant Examiner*—Marlon T. Fletcher
*Attorney, Agent, or Firm*—Woodbridge & Associates

[57] ABSTRACT

A key-pad operating mechanism of the saxophone for forcibly separating a normally closed key-pad from the tone hole seat via an arm using the leverage principle by pressing the operating lever for the normally closed key-pad even if the normally closed key-pad is stuck to the tone hole seat. The mechanism can easily open the normally closed key-pad without affecting any traditional maneuverability of the instrument and prevents key-pads from becoming inoperable during a play.

8 Claims, 5 Drawing Sheets

KEY-PAD OPERATING MECHANISM OF SAXOPHONE

BACKGROUND OF THE INVENTION

1. Field of the Invention

The present invention relates to the key-pad operating mechanism of saxophone preventing inoperative conditions due to stickiness of the key-pad.

2. Description of the Related Art

In general, a saxophone comprises a body (main tube) 101 of a metal tube generally curved in a J-shape, as shown in FIG. 4.

The body 101 is connected on one end of it to a bell (opening) 102 expanding in a bell-shape, and to a crook (blow tube) 103 on the other end thereof. A mouthpiece 104 is detachably attached to the crook 103. A reed (not shown) is attached to the mouthpiece 104. When the player blows air into the mouthpiece 104, the reed vibrates. This vibration is transmitted through the body 101 and exits from tone holes $O_{100}$ (see FIGS. 5, 6 and 7) and the bell 102.

The body 101 is normally provided with 18–25 tone holes $O_{100}$ The player adjusts the pitch (of sound) by opening and closing appropriate key-pads $K_{100}$ provided on the tone holes $O_{100}$. The pitch is basically determined by the distances from the mouthpiece 104 to the tone holes $O_{100}$. In other words, the further the opened tone holes $O_{100}$ are from the mouthpiece 104, the pitch is lower, and the nearer, the higher. Of these tone holes $O_{100}$, two tone holes $O_{101}$ and $O_{102}$ are the octave holes for generating harmonics. Other tone holes $O_{100}$ are for generating semitones; generating a semitone change when a tone hole is opened or closed.

Various mechanisms have been devised historically to operate these key-pads $K_{100}$ including mechanisms for opening and closing as well as levers and such for connecting key-pads themselves, so that they can be operated with ten fingers of a player. These mechanisms are well established today. Therefore, it is said that any changes to the key-pad operating mechanism of the saxophone are not desirable from the standpoint of the easiness of playing, particularly the uniformity of fingering during a play. However, there shouldn't be any problem in improving the key-pad operating mechanism of the saxophone as long as the change does not cause any problems in playing and or changes in fingering.

The key-pads $K_{100}$ are directly operated to open or close as shown in FIG. 5 via operating levers $L_{100}$ which are generally operated by fingers. The operations of these operating levers $L_{100}$ are transmitted through actuating levers $M_{100}$. A key-pad $K_{100}$, as shown in FIG. 5, has a relatively soft pad 111 that comprises a paperboard 107, a felt disc 108, a leather pouch 109 that covers them, and a reflection plate 110, and is contained in a skirt section 106*a* of a cap body 106, to which an operating lever $L_{100}$ is attached. The pad 111 is glued with adhesive 112 to the cap body 106. In order to close a tone hole $O_{100}$, the soft pad 111 seats nicely on a seat $Oa_{100}$ formed upward on the edge of the tone hole $O_{100}$.

The key-pads $K_{100}$ of the saxophone are basically divided into normally open and normally closed key-pads. The normally open key-pad $Kno_{100}$ is kept away normally from the corresponding tone hole $O_{100}$ to maintain an opened condition by means of the spring force of a spring 114 that acts on the corresponding lever $L_{100}$, while the normally closed key-pad $Knc_{100}$ is kept normally contacting the corresponding tone hole $O_{100}$ to maintain a normally closed condition.

The normally closed key-pad $Knc_{100}$, as shown in FIG. 6, is attached with a lever $L_{100}$, which is designed to rotate around a fulcrum 115 on a support pillar $P_{100}$ erected on the body 101. Moreover, a base end 114*a* of the spring 114 is affixed to the vicinity of the pad 111, while the other end 114*b* is extended beyond the support pillar $P_{100}$ to the side of a pressing part 116 of the operating lever $L_{100}$ to contact the body 101. Consequently, when the normally closed key-pad $Knc_{100}$ is pressed in the direction of an arrow Da as shown in the diagram against the spring force of the spring 114, the pad 111 rotates in the direction of an arrow Db to open the tone hole $O_{100}$. Also, the normally closed key-pad $Knc_{100}$ normally maintains its closed position with the pad 111 seated on the tone hole $O_{100}$ due to the spring force 114.

The normally open key-pad $Kno_{100}$ is equipped with two support pillars $P_{100}$ and $P_{100}$ erected on the body 101 as shown in FIG. 7. The normally open key-pad $Kno_{100}$ is further equipped with two operating levers $La_{100}$ and $Lb_{100}$ so that they can rotate around fulcrums 115*a* and 115*b* on the supporting pillars $P_{100}$ and $P_{100}$. Abase end 117*a* of a spring 117 is affixed to the rear end of a front operating lever $La_{100}$. The other end 117*b* of the spring 117 is extended beyond the pillar $P_{100}$ to contact the body 101. When this normally open key-pad $Kno_{100}$ is operated by pressing a pressing part 116 of an operating lever $Lb_{100}$ resisting the spring force of the spring 117 in the direction of the arrow Da shown in the drawing, the pad 111 rotates in the direction of the arrow Dc to close the tone hole $O_{100}$. The normally open key-pad $Kno_{100}$ normally keeps the pad 111 in an open position relative to the tone hole $O_{100}$ due to the spring force of a spring 117.

Now, the pad 111 of the key-pad $K_{100}$ comprises, as mentioned before, the baseboard 107, felt 108 and leather pouch 109 which are all humidity absorbing materials, so that they can easily absorb moisture from the environment and cause stickiness. Moreover, when this wetness attracts dirt, it tends to cause the pad Ill to stick to the seat $Oa_{100}$ of the tone hole $O_{100}$ and makes it difficult to be released. This gives the player an impression that it is an instrument difficult to play, and affects the performance as well.

In playing a saxophone, sometimes the music is of a slow tempo, but sometimes it is of a quick tempo. When playing quick tempo music, the pressing of the operating levers $L_{100}$ that activate key-pads $K_{100}$ is done with a light touch. As a result, if the pads 111 are sticking to the seats $Oa_{100}$, the pads 111 fail to operate properly or become inoperative and cause improper sounds resulting in a bad performance even though the player precisely plays the saxophone.

Particularly, even a single occurrence of inactivity of a key-pad $K_{100}$, if it occurs during a professional's playing, can adversely affect the performance that follows and the integrity of the entire music.

This tendency of causing inoperative conditions is such that the conditions can occur either with the normally open or normally closed key-pads. However, the tendency is more conspicuous with normally closed key-pads $Knc_{100}$. Since a normally open key-pad $Kno_{100}$ has more air flow through the area in question, it tends to cause less sticking of its pad 111. In other words, a normally closed key-pad $Knc_{100}$ is normally in contact with the seat $Oa_{100}$ of the tone hole $O_{100}$, so that there is very little air flow through it except when it is opened in playing or in maintenance. Therefore, the pad 111 tends to absorb moisture and attracts dirt, thus causing it to be sticky and making the pad 111 difficult to be removed from the seat $Oa_{100}$ of the tone hole $O_{100}$.

More specifically, a saxophone has key-pads $K_{100}$ for sounds such as A, B, $B^{\flat}$, C, $C^{\sharp}$, D, E, F, $F^{\sharp}$, G, $G^{\sharp}$, low $C^{\sharp}$, low B, and low Bb, of which the normally closed key-pads $Knc_{100}$ are low C♯ and G♯ key-pads. Of these, the G♯ key-pad, the most typical normally closed key-pad $Knc_{100}$, tends to become inoperative most frequently. This G♯ key-pad is located in the middle of the vertical array of key-pads on a saxophone, and is operated most often, so that professional players are most concerned about its performance.

SUMMARY OF THE INVENTION

The purpose of the present invention is to provide a key-pad operating mechanism of saxophone that prevents the key-pads from causing inoperative conditions during a play without causing any changes to their traditional operating characteristics.

One aspect of the present invention concerns a key-pad operating mechanism with a plurality of tone holes, normally closed or normally open key-pads provided on each of the tone holes, and operating levers that allow a player to selectively open or close desired tone holes by pressing the key-pads, the mechanism comprising: an actuating lever that moves up and down by operating the operating lever for the normally closed key-pad; an actuating lever that is provided adjacent to the normally closed key-pad and moves up and down by operating the operating lever for the normally open key-pads; and an arm having an abutting point that abuts the actuating lever of the normally open key-pads; the arm opening the normally closed key-pad that is closing the tone hole using the abutting point as a fulcrum when the operating lever for the normally closed key-pad is pressed.

In a case where stickiness occurs with a normally closed key-pad, so that it is stuck to the seat of the tone hole, or its opening or closing requires extra effort, pressing the operating lever for the normally closed key-pad causes the normally closed key-pad to separate from the seat of the tone hole forcibly through an arm. The mechanism allows us to easily pry open the normally closed key-pad due to the leverage principle. As a result, it prevents the normally closed key-pads from causing any inoperative conditions during a play. Further, it prevents the key-pads from causing any disruptive sounds or disturbances during a play, and guarantees accurate sounds and smooth performances.

The objects, features, and characteristics of this invention other than those set forth above will become apparent from the description given herein below with reference to preferred embodiments illustrated in the accompanying drawings.

BRIEF DESCRIPTION OF THE DRAWINGS

FIG. 2 shows the relation between the arm and the actuating lever, wherein FIG. 2A is a schematic cross sectional view taken on line 1A—1A of FIG. 1, showing the relation between the actuating levers M1 and M2, while

DETAILED DESCRIPTION OF THE PREFERRED EMBODIMENT

The embodiments of this invention will be described below with reference to the accompanying drawings.

Figure 1:
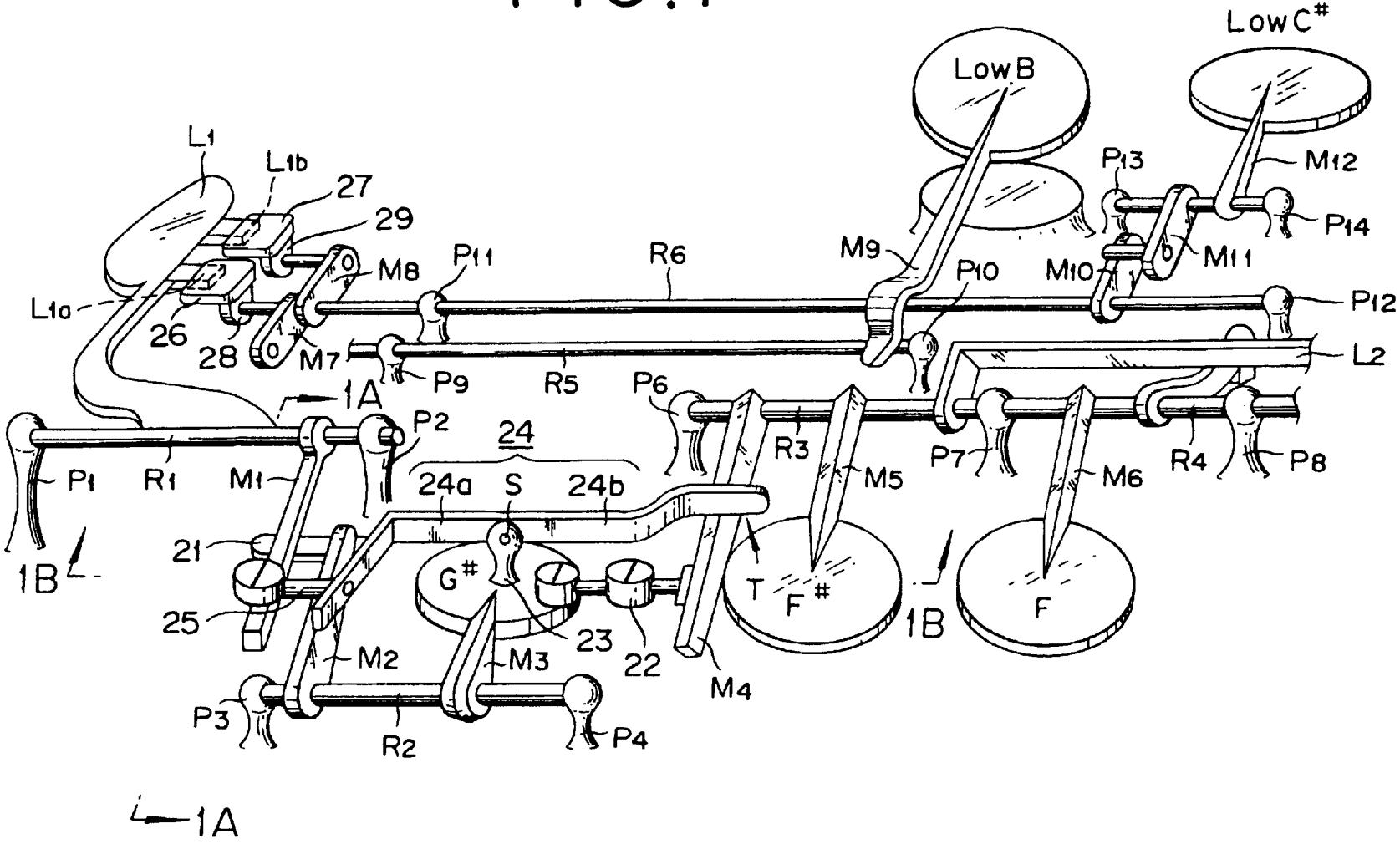
FIG. 1 is a perspective view of the essential parts of a saxophone related to an embodiment of the present invention.

The saxophone related to the embodiment of the present invention has a key-pad operating mechanism as shown in FIG. 1. In this key-pad operating mechanism, the G♯ key-pad, which is a normally closed key-pad Knc, and the F♯ key-pad, which is a normally open key-pad Kno, are connected so that the G♯ key-pad can be forcibly opened when needed.

Figure 2A:
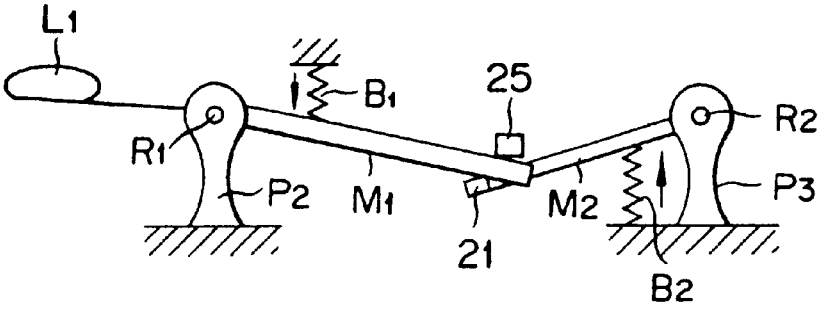

In this key-pad operating mechanism, multiple support pillars P1 through P14 are erected on the outer surface of the body and rotating shafts R1 through R6 are provided between these supporting pillars P1 through P14. The rotating shaft R1 shown on the top left corner of the drawing is provided with an operating lever L1 for the G♯ key-pad and an actuating lever M1 to be rotated via the rotating shaft R1 when the operating lever L1 is pressed. This actuating lever M1 is pressed downward by a spring B1 as shown in FIG. 2A.

A rotating shaft R2 provided between the support pillars P3 and P4 is attached with actuating levers M2 and M3 with their base ends affixed thereto. A protruding lever 21 comprising a screw and others is protruding sideward from the distal end of the actuating lever M2. This protruding lever 21 abuts the bottom surface of the actuating lever M1. The G♯ key-pad is attached to the distal end of the actuating lever M3. These actuating levers M2 and M3 are pressed upward by a spring B2.

Figure 5:
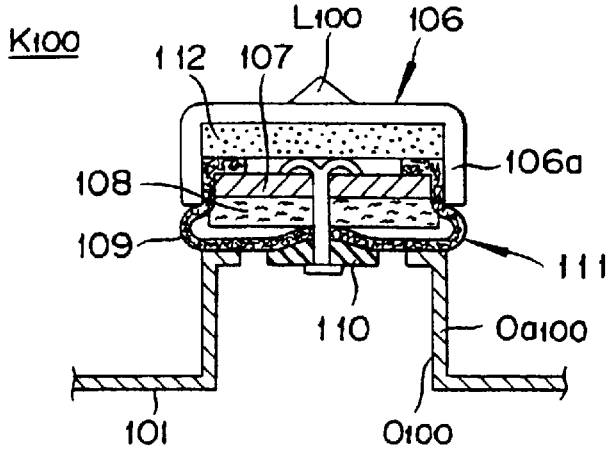
FIG. 5 RELATED ART
FIG. 5 is a cross section of the key-pad section of the conventional saxophone.
Figure 6:
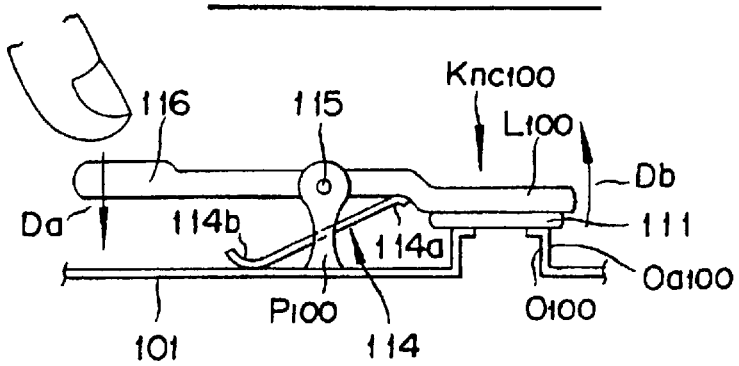
FIG. 6 RELATED ART
FIG. 6 is an explanatory schematic drawing of the normally closed key-pad of the conventional saxophone.
Figure 7:
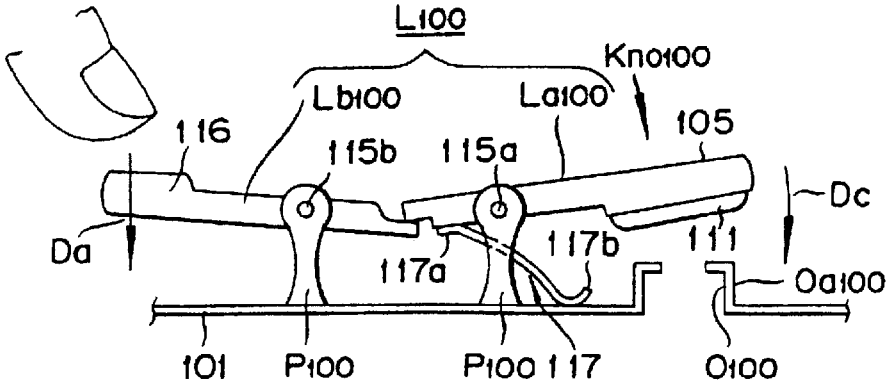
FIG. 7 RELATED ART
FIG. 7 is an explanatory schematic drawing of the normally open key-pad of the conventional saxophone.

The G♯ key-pad is normally closed and is constituted as shown in FIGS. 5 and 6. Without going into detailed explanations, let us say that the force of the spring B2 that is pressing the actuating levers M2 and M3 upward is weaker than the spring force that is creating the normally closed condition for the G♯ key-pad. Therefore, the G♯ key-pad is maintained in a condition of being seated on the seat Oa of the tone hole O. The force of the spring B1 that is pressing the actuating lever M1 downward also contributes to the operation of the G♯ key-pad.

When the operating lever L1 for the G♯ key-pad is pressed downward with a finger, the actuating lever M1 rotates upward and relieves the protruding lever 21 from the abutment therewith. Consequently, the G♯ key-pad tends to be pushed upward resisting the spring force which has been causing it to be closed.

The rotating shaft R3 provided between the supporting pillars P6 and P7 is attached with actuating levers M4 and M5 with their base ends affixed thereto. The actuating lever M4 is situated on the side of the F♯ key-pad. A protruding lever 22 comprising a screw and others is protruding sideward from the distal end of the actuating lever M4 and extends above the G♯ key-pad. In other words, the lever 22 abuts the top surface of the G♯ key-pad when the F♯ key-pad closes the tone hole O. The F♯ key-pad is attached to the distal end of the actuating lever M5. This F♯ key-pad is normally open and constituted as shown in FIGS. 5 and 6, but its details will not be explained here.

The rotating shaft R4 provided between the supporting pillars P7 and P8 is attached with an actuating lever M6 with it's base end affixed thereto. The F keypad is attached to the distal end of the actuating lever M6.

Figure 2B:
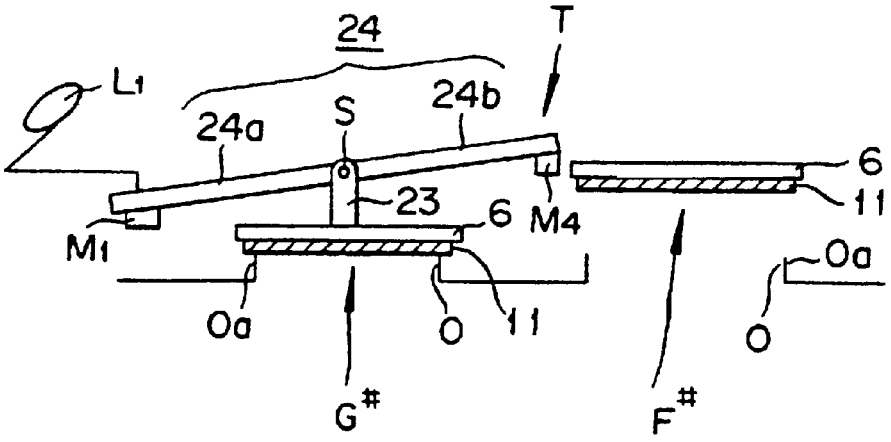
FIG. 2B is a schematic cross sectional view taken on the line 1B—1B of FIG. 1, showing the coordinating relation between the arm 24 and the actuating levers M1, M4.

As a unique feature of this embodiment, a supporting pillar 23 is erected on the cap body of the normally closed G♯ key-pad as shown in FIG. 1 and FIG. 2B. An arm 24 is connected to this supporting pillar 23 in such a way as to be able to rotate around a fulcrum S. One side 24*a* of the arm 24 is bent in an L-shape as shown in FIG. 1. The side 24*a* of the arm 24 is provided with a protruding lever 25 protruding from the distal end thereof sideward and is placed on the actuating lever M1. The other side 24*b* of the arm 24 is placed on the actuating lever M4. Therefore, by arranging the abutment point T between the actuating lever M4 and the other side 24*b* of the arm 24 to be located close to the rotating shaft R3, the spring force for normally opening the F♯ key-pad that is held in the F♯ key-pad can be utilized for transmitting its strong force to the actuating lever M4 when it is desired to move the actuating lever M4 upward. As a result, the abutment point T can be used as a solid, vertically stable fulcrum for the arm 24.

The operating lever L1 for the G♯ key-pad is further provided with mechanisms for respectively operating the low B, which is a normally open key pad, and the low C♯ key-pad, which is a normally closed key-pad. Here, the word "low" means the lowest sound obtainable for the particular sound group; in other words, low C is the lowest among the C-sounds.

This operating mechanism comprises: protruding levers L1*a* and L1*b*, which are plate-like levers protruding horizontally from the operating lever L1 for the G♯ key-pad; pusher parts 26 and 27 that are attached to the protruding levers L1*a* and L1*b* respectively; vertical levers 28 and 29 that are suspending from the bottom surfaces of the pusher parts 26 and 27; actuating levers M7 and M8 that transmit the actions of the vertical levers 28 and 29 to the rotating shafts R5 and R6; and actuating levers M9 through M12 that are actuated by the rotations of these rotating shafts R5 and R6. The actuating lever M9 is attached with the low B key-pad. The actuating lever M12 is attached with the low C♯ key-pad.

Next, let us explain about the actions of the G♯ key-pad and the F♯ key-pad referring to FIG. 3. Incidentally, FIG. 3A shows the conditions of the G♯ key-pad and the F♯ keypad when they are generating the G sound. FIG. 3B shows the conditions of the G♯ key-pad and the F♯ key-pad when they are switched from the G sound generating status to a G♯ sound generating status. FIG. 3C shows the conditions of the G♯ key-pad and the F♯ key-pad when they are switched from the G sound generating status to an F♯, F, E, or D sound generating status. FIG. 3D shows the conditions of the G♯ key-pad and the F♯ key-pad when they are switched from the low C sound generating status to the low C♯, low B, or low B♭ sound generating status. FIG. 3E shows the conditions of the G♯ key-pad and the F♯ key-pad when they are switched from the low C♯, low B, or low B♭ sound generating status to a G♯ sound generating status.

G Sound

Figure 3A:
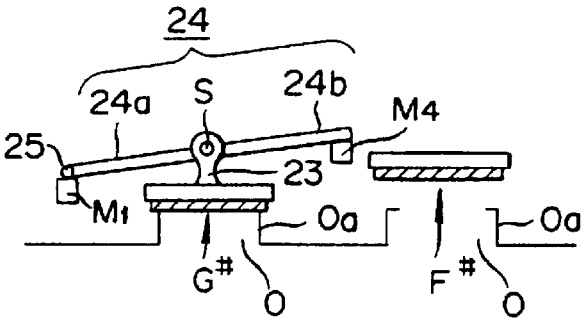
FIGS. 3A through 3E are explanatory drawings indicating the actuating conditions related to the G♯ and F♯ key-pads of the present embodiment.

The condition for generating a G sound is the basic setting condition for the operating mechanism of the present embodiment. The condition for generating a G sound is a condition wherein the G sound keypad is open and the operating lever L1 is not operated. Therefore, neither the G♯ key-pad nor the F♯ key-pad is operated, in other words, the normally closed G♯ key-pad is closed and the normally open F♯ key-pad is open as shown in FIG. 3A. In other words, the G♯ key-pad is abutting the seat Oa of the tone hole 0 by means of the force of its own spring provided for creating the normally closed condition while resisting the force of the spring B1 provided for the active lever M1. The F♯ key-pad is being separated from the seat Oa of the tone hole O due to the force of its own spring provided for creating the normally open condition. At the same time, the actuating lever M3 coaxially attached to the rotating shaft R3 is situated in an up position.

As a result, providing a mechanism that connects the G♯ key-pad with the F♯ key-pad does not affect the existing key pads at all.

G Sound•G♯ Sound

Let us now explain how to generate G♯ from the original condition of the operating mechanism.

Figure 3B:
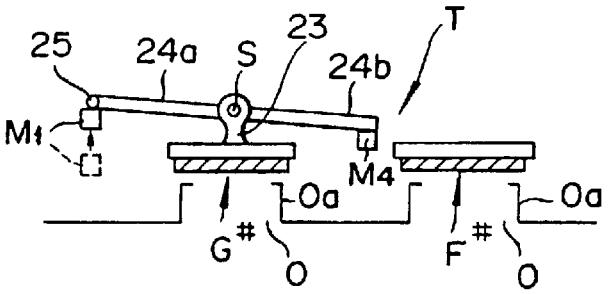

When the operating lever L1 for G♯ is pressed down by a finger from the condition for generating a G sound, the rotating shaft R1 rotates. As a result, the actuating lever M1 that is attached to the shaft rotates also, moving the protruding lever 25 upward. This upward motion of the protruding lever 25, as shown in FIG. 3B, causes the side 24*a* of the arm 24 to move upward around the fulcrum S.

In the meantime, the other side 24*b* of the arm 24 is sitting on the actuating lever M4, which is currently at its up position. Therefore, the arm 24 rotates using the abutment point T between the other side 24*b* of the arm and the actuating lever M4 as a fulcrum. Thus the arm 24 removes the G♯ key-pad from the seat Oa of the tone hole O accompanying the supporting pillar 23 to open the tone hole.

In other words, even if the G♯ key-pad has been attached to the seat Oa of the tone hole O as it has absorbed moisture, etc., and has become sticky, the push down force of the finger applied to the operating lever L1 for the G♯ key-pad, in addition to the force of the spring B2 and the force of the spring B1 attached to the actuating lever M1, causes it to be pried open.

As a consequence, the G♯ key-pad will never become inoperative during a play, thus preventing the occurrence of any disruptive sounds or disturbances during a play, and enabling always accurate sounds and smooth performances.

G Sound•F♯, F, E, D Sounds

Let us now explain how to generate an F♯ sound from the G sound generating condition.

The condition for generating a G sound is as shown in FIG. 3A, wherein the G key-pad is open, the G♯ key-pad is closed, and the F♯ key-pad is open. Although different key-pad operations are required to generate F♯, F, E, and D sounds respectively, they can be regarded equal in relation to the operating mechanism of the present embodiment. Hence, let us take the case of generating an F♯ sound as an example.

Figure 3C:
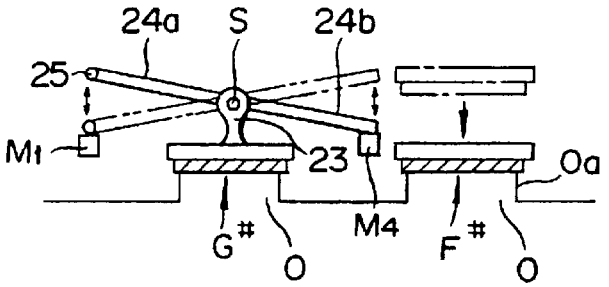

Since the F♯ key-pad is a normally open key-pad, an F♯ sound is generated when it is closed. Therefore, from the condition for generating a G sound, or from the condition when the G♯ key-pad is closed and the F♯ key-pad is open, the operating lever L2 for F♯ is pressed down by a finger to cause the rotating shaft R3 to rotate. Then the actuating lever M5 attached to the shaft rotates downward accompanying the actuating lever M4. As a result, the F♯ key-pad closes the seat Oa of the tone hole O and the actuating lever M4 lowers as well as shown in FIG. 3C.

In the meantime, since the operating lever L1 for the G♯ key-pad is not pressed down, it is at its up position, and the actuating lever M1 is at its down position. Therefore, the protruding lever 25 and the actuating lever M1 are not abutting each other.

Hence, the arm 24 is in a free state, without affecting at all the F♯ key-pad's function of closing the seat Oa of the tone hole O, thus allowing F♯ sound to be generated.

Low C Sound•low C♯, low B, Low B♭ Sound

Since the operating lever L1 for the G♯ key-pad is further connected to the operating mechanism that operates the low B and low C♯ key-pads, these relations will be explained below.

The condition for generating the low C sound is a setting opposite to the condition for generating a G sound (condition shown in FIG. 3A). In other words, it is the condition wherein the operating lever L1 is not yet actuated, the G♯ key-pad is open, the operating lever L2 is pressed, and the normally open F♯ key-pad is closed. Although different key-pad operations are required to generate low C♯, low B, and low B♭ sounds respectively, they can be regarded equal in relation to the operating mechanism of the present embodiment. Hence, let us take the case of generating the low C♯ sound as an example.

In order to generate the low C♯ sound from the low C sound generating condition, the operating lever L1 is pressed. Then this action will be transmitted to the protruding lever L1*b*, pusher part 27, vertical lever 29, rotating shaft R6, and to actuating levers M10, M11, M12, thus opening the low C♯ key-pad.

Figure 3D:
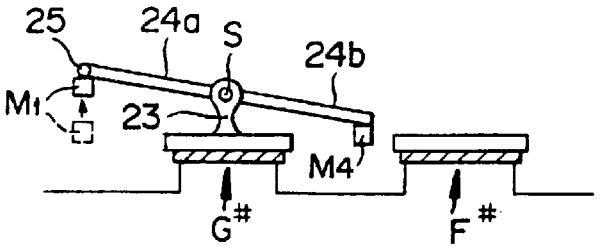

Since the operating lever L1 is pressed down, the G♯ key-pad tries to open as well. However, the F♯ key-pad is being held down by the operating lever L2. Therefore, the protruding lever 22 extending from the side of the actuating lever M4 and covering the G♯ key-pad prevents the G♯ key-pad from leaving the tone hole O and keeps it closed. At this time, both the G♯ and F♯ key-pads keep the tone holes O closed as shown in FIG. 3D. Therefore, the low C♯ sound can be generated from the low C sound generating condition by simply pressing down the operating lever L1 for the G♯ key-pad while leaving the F♯ key-pad closed. In brief, the low C♯ sound can be generated without affecting or causing any burden to other existing key-pads.

Low C♯, low B, low B♭ sound•G♯ Sound

Let us now explain how a G♯ sound is generated from the low C♯ sound generating condition. As explained before, the G♯ sound is in the closed condition pressed down from the F♯ key-pad side when the low C♯ sound is being generated. In order to generated a G♯ sound from this condition, the pressure from the actuating lever L2 for the F♯ sound has to be relieved to create an open condition for the F♯ key-pad.

Figure 3E:
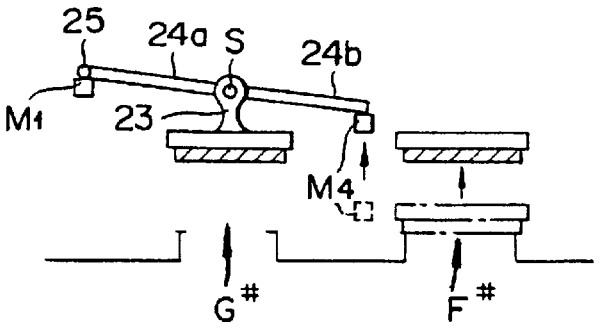
Figure 4:
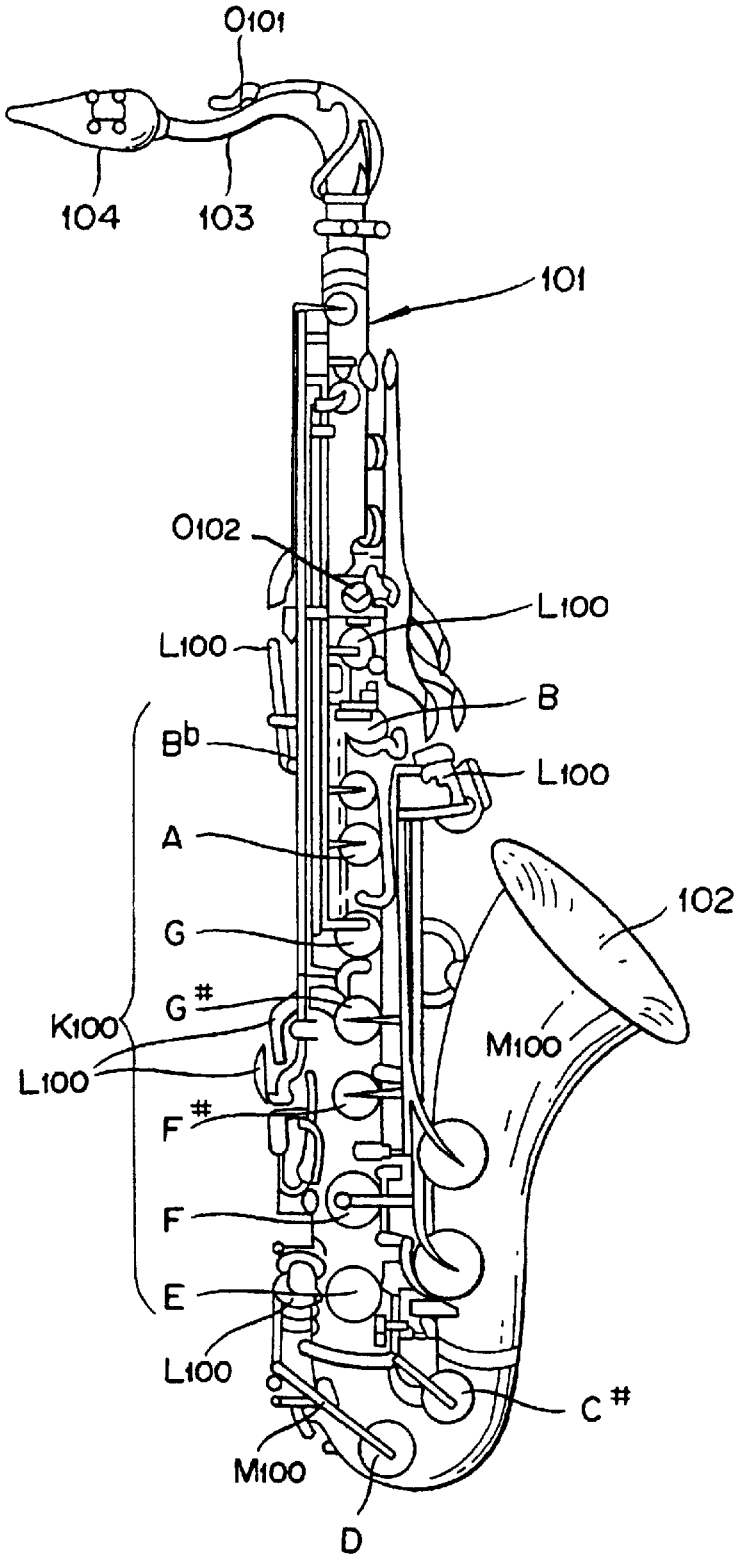
FIG. 4 RELATED ART
FIG. 4 is a front view of a conventional saxophone.

Particularly, press the actuating lever M1 for the G♯ key-pad to rotate the protruding lever 25 upward and to relieve the pressure of the actuating lever M5 for the F♯ sound at the same time, to open the F♯ key-pad. This causes the protruding lever 25 to go upward and move the arm 24*a* upward around the fulcrum S as shown in FIG. 3E. On the other hand, the F♯ key-pad becomes normally open due to the release of the actuating lever M5 for the F♯ sound. This causes the actuating lever M5 to be in the up position. Consequently, the other side 24*b* of the arm 24 rotates also around the fulcrum S and goes upward with the actuating lever M5. The arm 24, accompanying the supporting pillar 23, removes the G♯ key-pad from the seat Oa of the tone hole O to open the tone hole O.

Thus, a G♯ sound can be generated by opening the key-pad for the G♯ sound and opening the F♯ key-pad as well.

As described above, in the key-pad operating mechanism of the saxophone of the present embodiment, the normally closed key-pads can be forcibly opened, even if they are stuck to the seat of the tone hole, by pressing the operating lever of the normally closed key-pads via arms. In other words, the normally closed key-pads can be easily relieved due to the leverage principle. As a consequence, the normally closed key-pads will never become inoperative during a play, thus preventing the occurrence of any disruptive sounds or disturbances during a play, and enabling always accurate sounds and smooth performances.

Moreover, in the key-pad operating mechanism of the saxophone of the present embodiment, the abutment part between the actuating lever and the other side of the arm may be placed as close as possible to the rotating shaft. In the case, it is possible to support the actuating lever with a stronger force to actuate the actuating lever. Particularly, it is possible to make the actuating lever to operate upward using the spring force of the normally open key-pad using the abutment point as a vertically stable fulcrum. Thus, a normally closed key-pad can be easily freed from a condition stuck to the seat.

It is obvious that this invention is not limited to the particular embodiments shown and described above but may be variously changed and modified without departing from the technical concept of this invention.

Further, the entire disclosure of Japanese Patent Application No. 09-095984 filed on Apr. 14, 1997, including the specification, claims, drawings and summary are incorporated herein by reference in its entirety.

What is claimed is:

1. A key-pad operating mechanism for an instrument with a plurality of tone holes, including normally closed and normally open key-pads provided on the tone holes, and operating levers that allow a player to selectively open or close desired tone holes by pressing the key-pads, the mechanism comprising:

an actuating lever that moves up and down by operating the operating lever for the normally closed key-pad;

an actuating lever that is provided adjacent to the normally closed key-pad and that moves up and down by operating said operating lever for the normally open key-pads; and an arm having an abutting point that abuts said actuating lever of the normally open key-pads, said arm including a driven point that moves up and down by operating said actuating lever for the normally closed key-pad, and a connecting part that is connected to the normally closed key-pad and positioned between the abutting point and the driven point, wherein said arm opens the normally closed key-pad that closes the tone hole using the abutting point as a fulcrum when the operating lever for the normally closed key-pad is pressed.

2. A key-pad operating mechanism according to claim 1 further comprising:

a supporting pillar erected on the normally closed key-pad, wherein said connecting part is attached to said supporting pillar so as to pivot freely.

3. A key-pad operating mechanism according to claim 1 in which said actuating lever for said normally open key-pad has a rotating shaft and the abutting point of said arm is placed close to said rotating shaft.

4. A key-pad operating mechanism as claim 1, in which said instrument is a saxophone, and said tone hole is provided on a main body of the saxophone.

5. A key-pad operating mechanism according to claim 4, in which said tone hole that is opened or closed by the normally open key-pad is a F♯ hole and said tone hole that is opened or closed by the normally closed key-pad is a G♯ hole.

6. A key-pad operating mechanism for an instrument with a plurality of tone holes, said instrument including normally closed and normally open key-pads provided on said tone holes, and operating levers that allow a player to selectively open or close desired tone holes by pressing the key-pads, the mechanism comprising:

an actuating lever that moves up and down by operating the operating lever for the normally closed key-pad;

an actuating lever that is provided adjacent to the normally closed key-pad and which moves up and down by operating said operating lever for the normally open key-pads; and, an arm having a driven point that moves up and down by operating said actuating lever for the normally closed key-pad, a connecting part that is connected to said normally closed key-pad so as to pivot freely, and an abutting point that abuts said actuating lever of said normally open key-pads, wherein said driven point, said connecting part and said abutting point respectively corresponding to a power point, a first fulcrum and a second fulcrum, and wherein the distance from the power point to the second fulcrum is larger than the distance from the power point to said first fulcrum.

7. A key-pad operating mechanism according to claim 6, in which said arm opens said normally closed key-pad that closes said tone hole using said second fulcrum when said operating lever for said normally closed key-pad is pressed.

8. A key-pad operating mechanism according to claim 7, further comprising a supporting pillar, erected on said normally closed key-pad, wherein said connecting part is attached to said supporting pillar so as to pivot freely.

* * * * *